US010524968B2

(12) United States Patent
Allen

(10) Patent No.: US 10,524,968 B2
(45) Date of Patent: Jan. 7, 2020

(54) EMERGENCY RESCUE STRETCHER AND METHODS OF USING THE SAME

(71) Applicant: Fast Rescue Solutions, LLC, Flourtown, PA (US)

(72) Inventor: Eric Allen, Philadelphia, PA (US)

(73) Assignee: FAST RESCUE SOLUTIONS, LLC, Flourtown, PA (US)

( * ) Notice: Subject to any disclaimer, the term of this patent is extended or adjusted under 35 U.S.C. 154(b) by 77 days.

(21) Appl. No.: 15/570,903

(22) PCT Filed: Apr. 29, 2016

(86) PCT No.: PCT/US2016/030048
§ 371 (c)(1),
(2) Date: Oct. 31, 2017

(87) PCT Pub. No.: WO2016/178976
PCT Pub. Date: Nov. 10, 2016

(65) Prior Publication Data
US 2018/0289568 A1 Oct. 11, 2018

Related U.S. Application Data

(60) Provisional application No. 62/293,456, filed on Feb. 10, 2016, provisional application No. 62/155,737, filed on May 1, 2015.

(51) Int. Cl.
*A61G 1/044* (2006.01)
*A61G 1/048* (2006.01)
(Continued)

(52) U.S. Cl.
CPC ..... *A61G 1/044* (2013.01); *A61G 1/007* (2013.01); *A61G 1/048* (2013.01); *B63C 9/02* (2013.01);
(Continued)

(58) Field of Classification Search
CPC ..... A61G 1/003; A61G 1/007; A61G 1/04; A61G 1/042; A61G 1/044; A61G 1/048
See application file for complete search history.

(56) References Cited

U.S. PATENT DOCUMENTS 2,316,456 A * 4/1943 Robes, Jr. ..... A45F 3/10 224/156
2,511,061 A * 6/1950 Hughes ..... A61G 1/044 5/627
(Continued)

FOREIGN PATENT DOCUMENTS

| | | |
|---|---|---|
| DE | 202007016952 | 4/2009 |
| GB | 2403422 | 1/2005 |
| WO | 2012057668 | 5/2012 |

OTHER PUBLICATIONS

Rescue Tech Product Catalog; Rescue Equipment for the Technical Rope Professional; www.RescueTECH1.com; pp. 1-140; 2013.
(Continued)

*Primary Examiner* — Peter M. Cuomo
*Assistant Examiner* — Ifeolu A Adeboyejo
(74) *Attorney, Agent, or Firm* — Niels Haun; Dann, Dorfman, Herrell & Skillman, P.C.

(57) ABSTRACT

An emergency rescue stretcher for removing a victim from a confined space and methods of using the same are provided.

37 Claims, 11 Drawing Sheets

(51) Int. Cl.

| | |
|---|---|
| ***A61G 1/007*** | (2006.01) |
| ***B63C 9/02*** | (2006.01) |
| ***F41H 5/02*** | (2006.01) |
| *A62B 5/00* | (2006.01) |
| *F41H 5/04* | (2006.01) |

(52) U.S. Cl.
CPC ..... *F41H 5/02* (2013.01); *A62B 5/00* (2013.01); *F41H 5/0414* (2013.01); *F41H 5/0471* (2013.01)

(56) References Cited

U.S. PATENT DOCUMENTS 2,665,431 A * 1/1954 Elsner ..... A61G 1/06 5/9.1
2,788,530 A * 4/1957 Ferguson ..... A61G 1/01 5/628
3,046,982 A * 7/1962 Davis ..... A61G 1/044 128/875
3,104,116 A * 9/1963 Knight, Jr. ..... A61G 1/007 280/18
3,222,080 A * 12/1965 Kinraide ..... A61G 1/007 280/18
3,601,824 A 8/1971 Bradford
3,889,668 A * 6/1975 Ochs ..... A61F 5/05883 128/870
3,954,280 A * 5/1976 Roberts ..... B60R 22/105 280/801.2
4,127,120 A * 11/1978 Applegate ..... A61F 5/05883 128/DIG. 15
4,369,982 A * 1/1983 Hein ..... B62B 1/18 128/870
4,402,548 A * 9/1983 Mason ..... B60N 2/2806 297/464
4,569,095 A * 2/1986 Holling ..... A61G 1/044 5/628
4,655,206 A * 4/1987 Moody ..... A61G 1/01 5/628
4,736,474 A * 4/1988 Moran ..... A61G 1/007 5/627
4,742,821 A * 5/1988 Wootan ..... A61F 5/3776 128/873
4,794,656 A * 1/1989 Henley, Jr. ..... A61G 1/01 5/628
4,937,923 A * 7/1990 McEntire ..... A44B 11/2526 24/647
5,154,186 A * 10/1992 Laurin ..... A61F 5/058 5/625
5,179,746 A * 1/1993 Rogers ..... A61G 1/04 280/47.29
5,249,321 A 10/1993 Graf
5,253,885 A * 10/1993 McCracken ..... B62B 15/00 280/19
5,435,323 A * 7/1995 Rudy ..... A61F 5/05883 128/870
5,701,619 A * 12/1997 Ullman ..... A61G 1/01 5/625
5,720,303 A * 2/1998 Richardson ..... A61G 1/01 128/870
5,950,627 A * 9/1999 Bologovsky ..... A61G 1/00 128/869
6,175,977 B1 * 1/2001 Schumacher ..... A61G 1/04 128/845
6,443,157 B1 * 9/2002 Sargent ..... A61G 1/01 128/870
7,025,172 B2 4/2006 Gregory
7,168,110 B2 1/2007 Girard
7,426,761 B2 * 9/2008 Tomcany ..... A61F 5/3707 5/622
7,699,324 B2 4/2010 Walkingshaw
8,046,853 B1 * 11/2011 Von Felden ..... A61G 1/04 128/870
8,286,284 B2 10/2012 Fee
8,615,829 B2 12/2013 Kenalty
8,745,792 B2 6/2014 McGlynn
8,881,327 B2 11/2014 Kenalty
8,898,839 B2 * 12/2014 Kenalty ..... A61G 1/044 224/158
8,935,833 B2 * 1/2015 Kaneko ..... A44B 11/12 24/170
8,936,253 B1 * 1/2015 Rizzi ..... A61G 1/013 280/17
8,955,915 B2 * 2/2015 Mason ..... B60N 2/2812 297/216.11
8,991,835 B1 3/2015 Wolf
9,707,137 B2 * 7/2017 Boak ..... A61G 1/00
9,974,701 B1 * 5/2018 Haskell ..... A61G 1/044
2002/0036423 A1 3/2002 Glover
2002/0153680 A1 * 10/2002 Moore ..... A62B 1/02 280/20
2004/0045089 A1 * 3/2004 Zucker ..... A61G 1/04 5/655
2005/0193491 A1 * 9/2005 Zucker ..... A61G 1/04 5/603
2006/0061050 A1 3/2006 Wolf
2008/0086817 A1 * 4/2008 Zucker ..... A61G 1/04 5/603
2008/0168603 A1 * 7/2008 Ayette ..... A61G 1/044 5/628
2009/0173354 A1 7/2009 Gold
2010/0005593 A1 * 1/2010 Bowling ..... A61G 1/013 5/627
2010/0299837 A1 * 12/2010 Yandle ..... A61G 1/013 5/627
2011/0025004 A1 2/2011 Walkingshaw
2012/0272451 A1 * 11/2012 Haskell ..... A61G 1/01 5/628
2017/0112693 A1 * 4/2017 Cable ..... A61G 1/048
2018/0177649 A1 * 6/2018 Kenalty ..... A61G 1/013

OTHER PUBLICATIONS

Rescue and First Aid Equipment; Rosenbauer; www.resansil.com; pp. 335-363; Apr. 7, 2015.
Internation Search Report and Written opinion for corresponding International Application No. PCT/US16/30048; dated Aug. 9, 2016.
Extended European Search Report in corresponding European Application No. 16789818.8; dated Oct. 31, 2018.

* cited by examiner

EMERGENCY RESCUE STRETCHER AND METHODS OF USING THE SAME

CROSS-REFERENCE TO RELATED APPLICATIONS

This is a national stage application of International Application No. PCT/US2016/030048, filed Apr. 29, 2016, which claims the benefit of U.S. Provisional Application No. 62/155,737, filed May 1, 2015, and U.S. Provisional Application No. 62/293,456, filed Feb. 10, 2016, the entireties of which are incorporated herein by reference.

FIELD OF THE INVENTION

The present invention relates generally to devices and methods for securing distressed individuals and more particularly, but not exclusively, to an emergency rescue stretcher for removing a victim from a confined space.

BACKGROUND OF THE INVENTION

Stretchers are often used by emergency personnel to transport injured persons and victims from accident sites to an emergency transport vehicle or a hospital. Such stretchers are also designed in certain circumstances to secure the victim and prevent further injury.

People may become trapped or injured in a confined space or location, such as a basement or shaft. In such instances, ordinary stretchers may not fit within the confined space. For example, when fighting a fire, a fireman may be injured and trapped in a basement. Without the ability to secure the injured fireman on a stretcher, rescuers will tend to pull the fireman out by his or her equipment or clothing. This process often results in the removal of the fireman's equipment before extraction of the fireman from the basement as the equipment is prone to being pulled off during extraction. Moreover, rescuers may exacerbate a trapped fireman's injuries when attempting a rescue without securing the fireman's body before extraction.

Therefore, a present need exists in the field for a stretcher that may be used to efficiently secure and extract a person or victim from a confined space.

SUMMARY OF THE INVENTION

In some embodiments, the present invention sets forth an emergency rescue stretcher that meets the needs in the field and allows a rescuer to safely remove a victim or person from a confined space. As used herein, the term "confined space," may be defined as a substantially small or restricted space such as, for example, a basement, a shaft, a tunnel, a tank, a small compartment of a vessel, a void space in a collapsed structure (e.g., a collapsed building), and the like.

In one embodiment, the invention includes an emergency rescue stretcher. The emergency rescue stretcher may be used for removing a victim from a confined space. The stretcher may include a platform configured to support a victim. The platform may have an internal frame. The platform may have a channel that extends from an aperture on a surface of the platform. The platform may include a restraint lock.

The platform may be a rigid body that may enclose an internal frame and may be sufficiently rigid to allow for cardiopulmonary resuscitation of a victim that is secured to the rigid body and/or sufficiently rigid to immobilize a portion of the victim's spine. In certain embodiments, the platform may be a rigid body that may be hollow and/or may include a filler material.

In various embodiments of the invention, the rigid body may include a filler material. The filler material may be a buoyant filler material that may provide neutral buoyancy to a stretcher of the invention when bearing a victim in water and, therefore, at as a flotation device. For example, the buoyant filler material may include a foam polymer material (e.g., polyvinyl chloride foam and/or polyethylene foam). Additionally, the stretcher of the invention may include one or more additional buoyancy aids or flotation devices that may be affixed to the platform.

Moreover, the filler material of the invention may include a ballistic material. The ballistic materials of the invention may be resistant to penetration from bullets, shrapnel, debris, and other lethal missiles. The ballistic material of the invention may include a soft ballistic material and/or a hard ballistic material. For example, soft ballistic materials of the invention may include one or more of a para-aramid fiber-based ballistic material (e.g., Kevlar® and Twaron®) and a polyethylene fiber-based ballistic material (e.g., Spectra Shield®). The hard ballistic materials of the invention may include one or more of a ceramic-based material (e.g., a ceramic matrix composite (CMC) material) and a polycarbonate-based material (e.g., Lexan®).

Furthermore, the ballistic materials of the invention, which may be used as filler material, may be affixed to and/or coated on an interior or exterior surface of the rigid body. In certain embodiments of the invention, the platform may be composed of a ballistic material as described herein. Accordingly, certain stretchers of the invention may be used as shields during extraction operations when rescuing victims.

The sides of the platform may include one or more handholds for lifting the platform. The sides of the platform may also be curved such that they are substantially orthogonal to a plane that passes through the lower surface of the platform. More specifically, the sides of the platform may be curved away from the center of the platform at an angle $\theta$ that may be measured between a side of the platform and a plane passing through the lower surface of the platform. The angle $\theta$ may be about 45°.

The stretcher of the invention may include a first flexible restraint that may restrain a first portion of a victim, such as their torso. The first flexible restraint may also have a first locking member with a portion of the first flexible restraint being enclosed within the channel and releasably connected to the restraint lock in the channel. Moreover, the act of drawing the first flexible restraint through the channel may tighten the first flexible restraint against the victim when attached to the second flexible restraint.

The stretcher of the invention may include a second flexible restraint that may restrain a second portion of a victim, such as their pelvis. The second flexible restraint may also have second locking member with a portion of the second flexible restraint connected to the platform. The first and second locking members may be releasably connectable to maintain the victim at the platform.

The stretcher may also include a pull line that may be in communication with or otherwise coupled to the first flexible restraint for pulling the platform while drawing the first flexible restraint through the channel.

In certain embodiments, the first and/or second flexible restraint may include a strap, webbing, a cord, or a combination thereof. For example, the first flexible restraint may include a cord and the second flexible restraint may include webbing. The first and/or second flexible restraint may be composed of a polymer or a copolymer that includes, for example, polyamide (e.g., nylon), polypropylene, polyester, para-aramid (e.g., Kevlar®), Dyneema®, or a combination thereof.

The second flexible restraint may, alternatively or additionally, include a diaper harness in order to more evenly distribute a victims weight onto their pelvis when securing a victim on the stretcher.

In those embodiments wherein the platform includes an internal frame, the internal frame of the platform may include a tubular metal frame such as, for example, a square tubular frame, a circular tubular frame, or a combination thereof.

In certain additional embodiments of the invention, the stretcher may include one or more flaps that may be affixed to the platform and may be folded over a victim disposed on the stretcher. The flaps (e.g., two flaps) may be secured about the victim by one or more releasable fasteners. Moreover, the one or more flaps may include a soft ballistic material, as described herein.

In a second aspect, the present invention includes a method of removing a victim from a confined space using an emergency rescue stretcher of the invention. The method may include the step of providing an emergency rescue stretcher as described herein. The method may further include the step of placing the victim on the stretcher and drawing a first flexible restraint over the victim's head. The method may also include drawing a second flexible restraint between the victim's legs and connecting a first locking member on the first flexible restraint and a second locking member on the second flexible restraint. Additionally, the method may include the step of pulling a pull line, which may be in communication with or otherwise coupled to the first flexible restraint, to move the stretcher from the confined space and simultaneously tighten the first and/or second flexible restraint against the victim. In some embodiments, the pull line may be connected to the first flexible restraint.

Accordingly, the present invention provides an emergency rescue stretcher that meets the needs in the field by allowing rescuers and emergency personnel to remove a victim from a confined space while securing the victim's person on a platform.

BRIEF DESCRIPTION OF THE DRAWINGS

The foregoing summary and the following detailed description of the exemplary embodiments of the present invention may be further understood when read in conjunction with the appended drawings, in which.

DETAILED DESCRIPTION OF THE INVENTION

Figure 1A:
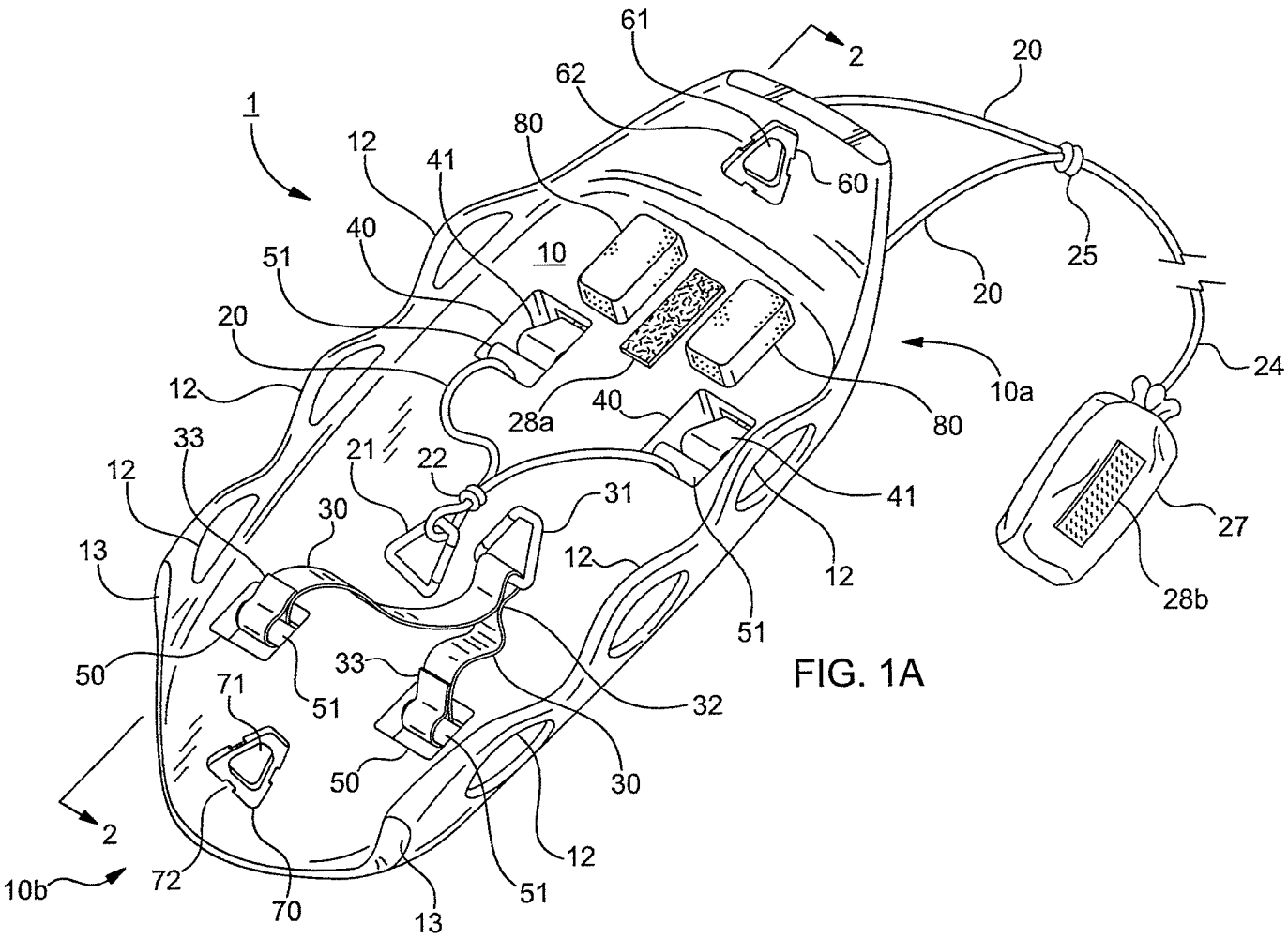
FIGS. 1A and 1B are rear (FIG. 1A) and front (FIG. 1B) perspective views of a first exemplary emergency rescuer stretcher of the invention.
Figure 1B:
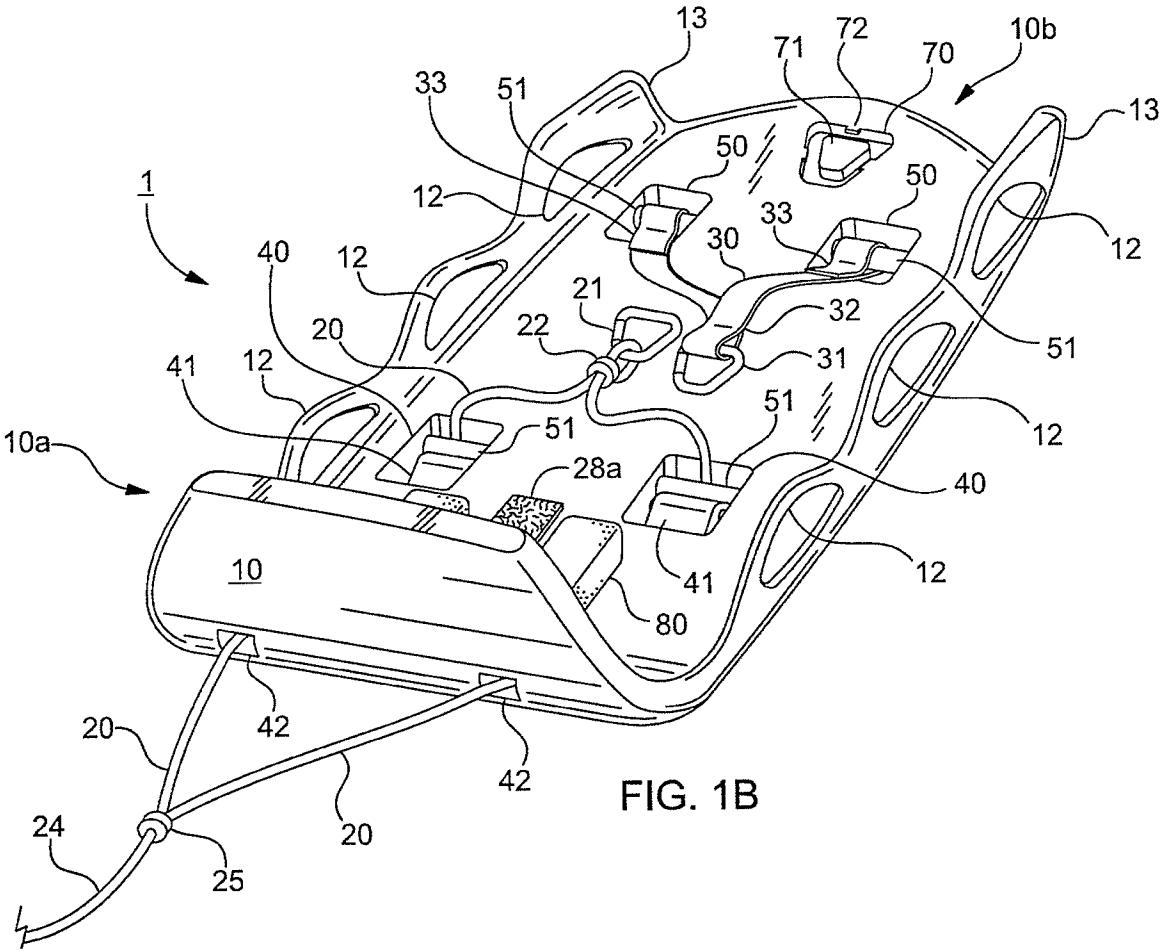
Figure 2:
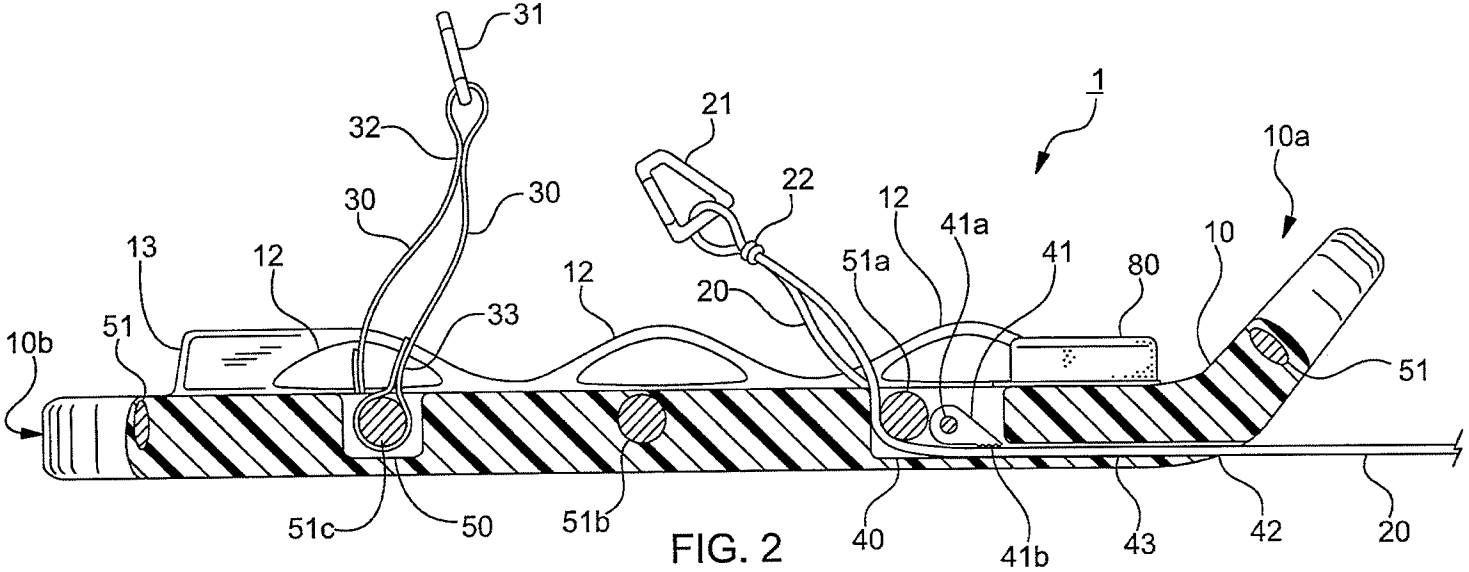
FIG. 2 is a side cutaway view of the first exemplary emergency rescuer stretcher of the invention.

Referring now to the figures, wherein like elements are numbered alike throughout, FIG. 1A, FIG. 1B, and FIG. 2 provide an exemplary emergency rescue stretcher 1 that may include a platform 10 having a first flexible restraint 20 and a second flexible restraint 30 that may be used to secure a victim on the stretcher for extrication from a confined space.

The platform 10 may be rigid or semi-rigid and, in some embodiments, may be a rigid body for supporting a victim restrained thereon. The platform 10 may be composed of a polymeric material, which may include polyethylene polymer, polypropylene polymer, polyamide polymer (e.g., nylon), para-aramid polymer (e.g., Kevlar®), Dyneema®, or any combination or copolymer thereof. The platform 10 may be sized to secure the head, torso, and pelvis of a victim. In some embodiments, the platform 10 may be a board that is substantially flat or, alternatively, concave to better support a victim disposed thereon. The platform 10 may have a top 10*a* and bottom 10*b*. In some embodiments, the top 10*a* may be curved upwardly from a top surface of the platform 10 to protect the victim's head and/or enable the stretcher 1 to be more easily pulled over obstacles or stairs. The length of the platform 10 may be about 30 to about 72 inches. The width of the platform 10 may be about 10 to about 30 inches. For example, the platform 10 may be about 40 inches long and about 16 inches wide. However, in certain embodiments, the platform 10 may be sized to support the head, torso, and pelvis of an average American male.

The platform 10 may be partially or completely hollow. Moreover, the platform 10 may also include a filler material disposed therein. The filler material may be a buoyant filler material that may provide buoyancy to a stretcher of the invention when bearing a victim in water and, therefore, act as a flotation device. For example, the buoyant filler material may include a foam polymer material (e.g., polyvinyl chloride foam and/or polyethylene foam). Additionally, the stretcher of the invention may include one or more additional buoyancy aids or flotation devices that may be affixed to the platform.

Moreover, the filler material of the invention may include a ballistic material. As used herein, "ballistic materials" may be defined as those materials known in the art that are resistant to penetration from bullets, shrapnel, debris, and other lethal missiles. Ballistic materials may include a soft ballistic material and/or a hard ballistic material. For example, soft ballistic materials of the invention may include one or more of a para-aramid fiber-based ballistic material (e.g., Kevlar® and Twaron®) and a polyethylene fiber-based ballistic material (e.g., Spectra Shield®). The hard ballistic materials of the invention may include one or more of a ceramic-based material (e.g., a ceramic matrix composite (CMC) material) and a polycarbonate-based material (e.g., Lexan®).

Furthermore, the ballistic materials of the invention, which may be used as filler material, may be affixed to and/or coated on an interior or exterior surface of the platform. Indeed, the platforms described herein may be composed of or otherwise comprise a ballistic material. Accordingly, certain stretchers of the invention may be used as shields during extraction operations when rescuing victims.

The platform 10 may include one or more hand holds 12 spaced about the sides of the platform 10 that allow rescuers to lift or carry the stretcher 1. For example, the platform 10 may have about 2 to 8 hand holds 12 that may be equally spaced along the sides of the platform 10. In some embodiments, the platform 10 may have 6 handholds 12 spaced along the sides of the platform 10 and running from the top 10*a* of the platform 10 to the bottom 10*b* of the platform 10. Additionally, the platform 10 may further include one or more push points 13 that may be disposed on the handholds 12 to provide a surface that may receive a pushing force parallel the length of the platform 10. For example, the two handholds 12 that oppose one another closest to the bottom 10*b* of the platform 10 may include push points 13 that may allow one or more rescuers to push the stretcher 1 up a flight of stairs when a victim may be disposed thereon.

The sides of the platforms of the invention, which may include one or more handholds, may be curved way for a plane that passes through the lower surface of the platform 10. For example the sides may be curved such that they are approximately orthogonal with respect to the plane that passes through the lower surface of the platform 10 (i.e., about 90°) as shown in FIGS. 1A and 1B. In other embodiments, the sides of the platform may be curved away from the plane that passes through the lower surface of the platform 10 at an angle θ, which may be about 45°. Several benefits may be obtained by angling the sides of the platform at about 45°. First, when extricating a victim placed on a stretcher of the invention, angling the sides of the platform may reduce the turn radius of the stretcher when sliding the stretcher around a turn. Second, angling the sides of the platform may make a stretcher of the invention more ergonomic when carried by rescue personnel who are gripping the platform by the handholds disposed on the sides of the platform. Third, angling the sides of the platform may allow a person or victim to be more easily retained on the platform.

The platform 10 may also include apertures 40, 42, and 50. Apertures 40 may include one or more apertures or cut outs on the victim facing surface of the platform 10 that are disposed proximate to the top 10*a* of the platform 10. Furthermore, apertures 50 may include one or more apertures or cut outs on the victim facing surface of the platform 10 that are disposed proximate to the bottom 10*b* of the platform 10. Platform 10 may include an internal frame 51. Apertures 40 and 50 may expose the internal frame 51 and, specifically, first strut 51*a* and third strut 51*c*.

Figure 3:
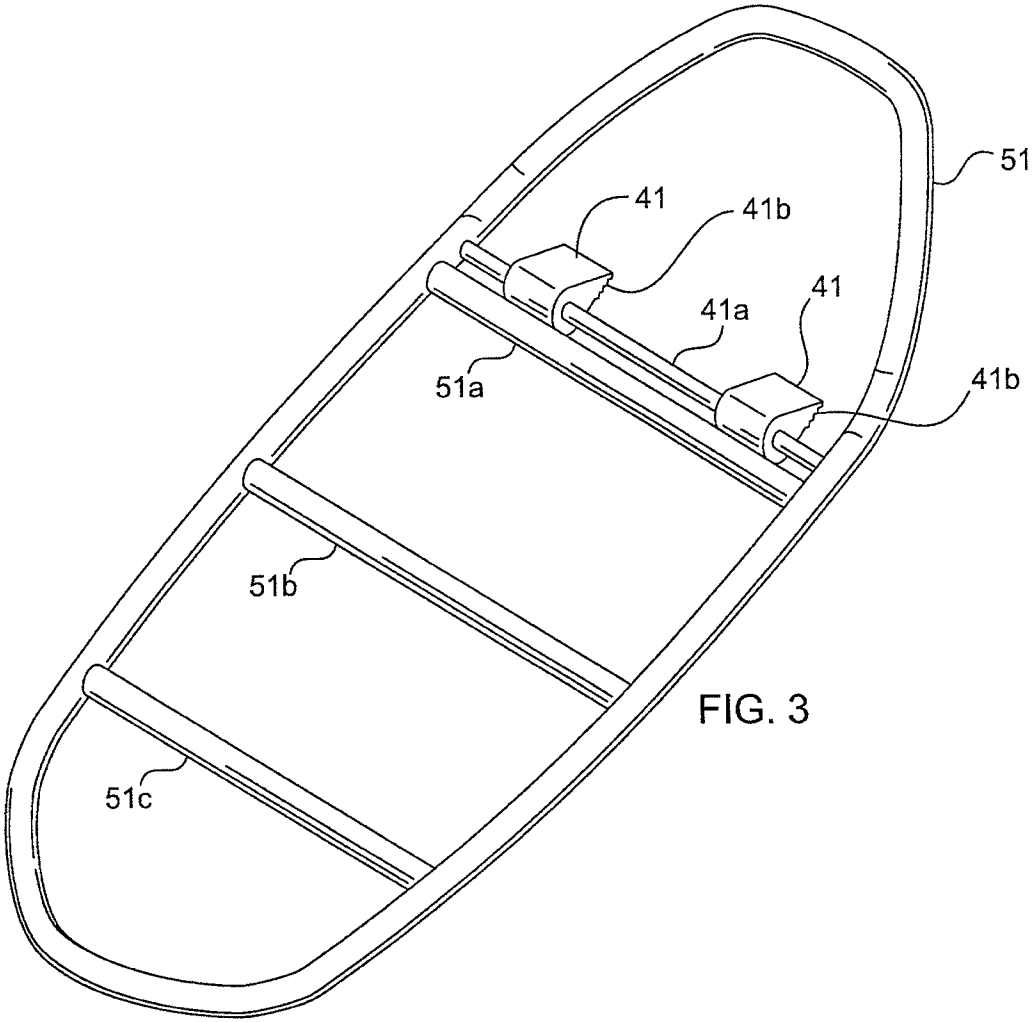
FIG. 3 is a perspective view of an exemplary internal frame of the invention that may be disposed within the first emergency rescue stretcher.

Internal frame 51 is shown in greater detail in FIG. 3. As shown therein, internal frame 51 may include several support struts, such as first strut 51*a*, second strut 51*b*, and third strut 51*c*. In some embodiments, the internal frame 51 may be a tubular metal frame. The tubular metal frames of the invention may have square cross sections, circular cross sections, or a combination thereof. In some embodiments, the internal frame 51 may be inserted into the platform 10 wherein the platform 10 may be opened to accept the internal frame 51 therein and then closed.

Apertures 40 may include restraint locks 41 and, preferably, two restraint locks. The platform 10 may further include one or more channels 43 that extend from apertures 40 to apertures 42, which are disposed on the underside of the platform 10 proximate to the top of the platform 10*a*. Alternatively, the apertures 42 may be disposed on the victim facing side of the platform 10.

The platform 10 may include a first flexible restraint 20 that may restrain a first portion of a victim on the platform 10. For example, the first portion of the victim may include the victim's torso. The first flexible restraint 20 may be a flexible piece of material that passes through apertures 40. The first flexible restraint 20 may preferably pass through apertures 40, restraint locks 41, channels 43, and apertures 42.

In some embodiments, restraint locks 41 may be friction locks that allow the first flexible restraint 20 to pass in one direction, but lock by friction and prevent the flexible restraint 20 from passing in the other direction. Additionally, restraint locks of the invention may include one or more teeth to increase their ability to lock or otherwise grasp a portion of flexible restraint or material that may pass therethrough. For example, as shown in FIG. 2, restraint locks 41 may rotate about restraint axle 41*a* that may be connected to the platform 10 and/or internal frame 51. Preferably, restraint axle 41*a* may be connected to internal frame 51. Moreover, restraint lock 41 may include friction pad 41*b*, which may include one or more teeth that may grip and/or restrict the motion of the first flexible restraint 20 through the channel 43.

Restraint lock 41 may apply a force against the first flexible restraint 20 through the use of spring disposed at the restraint lock 41 as would be understood by a person having ordinary skill in the art. In some embodiments, the restraint lock 41 may be a cam that may allow the first flexible restraint 20 to pass through the channel 43 and thus allow the first flexible restraint 20 to be tightened against the victim's torso. However, after tightening, the restraint lock 41 may prevent the loosening of the first flexible restraint 20, until the restraint lock 41 is released by manual lifting of the restraint lock 41 and/or rotating of the restraint lock 41 about restraint lock axle 41*a*, which may disengage friction pad 41*b* from the first flexible restraint 20.

Variations in the configuration of first flexible restraint 20, first strut 51*a*, and restraint lock 41 within the apertures 40 and channel 43 may affect the manner in which the stretcher 1 bears the loads placed upon stretcher 1 when a victim is secured to the platform 10. In one variation, the first strut 51*a* may be disposed away from the aperture 40 and the first flexible restraint 20 passes around and through the restraint lock 41. In a second variation, the first strut 51*a* may be disposed adjacent to the restraint lock 41 and first flexible restraint 20 passes through the apertures 40 and between the first strut 51*a* and the restraint lock 41. In a third variation, which is depicted in FIG. 2, the first strut 51*a* may be disposed adjacent to the restraint lock 41 within the apertures 40 and the first flexible restraint 20 may pass about the first strut 51*a* and through the restraint lock 41. This represents a preferred variation as the positioning of the first strut 51*a* in relation to the restraint lock 41 within apertures 40 allows the stretcher 1 to best manage the loads that result from the victim being secured at the victim facing surface of the platform 10.

In some embodiments, the first flexible restraint 20 may be a strap, webbing, cord, or a combination thereof. Particularly, the first flexible restraint 20 may be webbing (e.g., polyamide, polypropylene, polyester, para-aramid, and/or Dyneema® webbing) or cord (e.g., polyamide paracord). For example, the stretcher 1 in FIGS. 1A, 1B, and 2 includes a first flexible restraint 20 that may be cord.

The first flexible restraint 20 may also include a first locking member 21, which may be a clip, a buckle, tri-link, or a carabiner. In particular, the first locking member 21 may be a carabiner. Furthermore, the position of the first locking member 21 on the first flexible restraint 20 may be maintained by a first fixation element 22, which may be a knot in the first flexible restraint 20, a clamp, a splice, stitching (e.g., wherein at least two portions of the flexible restraint are sewn together), or a weld. Particularly, the first fixation element 22 may be a knot in the first flexible restraint 20.

The platform 10 may include a second flexible restraint 30 that may restrain a second portion of a victim on the platform 10. For example, the second portion of the victim may include the victim's pelvis. The second flexible restraint 30 may be a flexible piece of material that passes through apertures 50 and may be connected to the internal frame 51 at third strut 51*c* with joint 33. Joint 33 may be a knot in the second flexible restraint 30, a clamp, a splice, stitching, or a weld. Alternatively, the second flexible restraint 30 may be connected to the platform 10 rather than internal frame 51 by providing a loop or mounting point formed in the victim facing surface of the platform 10.

In some embodiments, the second flexible restraint 30 may be a strap, webbing, cord, or a combination thereof. Particularly, the second flexible restraint 30 may be webbing (e.g., polyamide, polypropylene, polyester, para-aramid, and/or Dyneema® webbing) or cord (e.g., polyamide paracord). For example, the stretcher 1 in FIGS. 1A, 1B, and 2 includes a second flexible restraint 30 that may be webbing.

The second flexible restraint 30 may also include a second locking member 31, which may be a clip, a buckle, tri-link, or a carabiner. In particular, the second locking member 31 may be a carabiner. Furthermore, the position of the second locking member 31 on the second flexible restraint 30 may be maintained by a second fixation element 32, which may be a knot in the second flexible restraint 30, a clamp, a splice, stitching, or a weld. Particularly, the second fixation element 32 may be stitching. For example, two or more portions of the second flexible restraint 30 may be stitched together in order to maintain the position of the second locking member 31 on the second flexible restraint 30.

Moreover, the second flexible restraints of the invention may include a harness, such as a diaper harness, for more advantageously distributing a victim's weight on their pelvis when securing the victim to the stretcher. Additionally, the harness may provide additional comfort to the victim during extraction from, for example, a confined space (e.g., vertical extraction of a victim from a collapsed building).

The first locking member 21 may be connectable with the second locking member 31 to maintain or secure a victim on the platform 10. For example, when connecting the first locking member 21 to the second locking member 31, tightening of the first flexible restraint 20 against a victim results in the tightening of the second flexible restraint 30. In some embodiments, the first locking member 21 and second locking member 31 are releasably connectable. As used herein, the term "releasably connectable" is intended to be representative of any connection method which can subsequently be disconnected without any destructive or disruptive measures or techniques used in the disconnection process. For example, a connection between clips, buckles, tri-links, and/or carabiners on the flexible restraints may be regarded as "releasable," while a connection via stitching is non-releasable as the connection has to be physically destructed to separate or disconnect the flexible restraints or any portions thereof.

Furthermore, the stretcher 1 may include a pull line 24 that may be in communication with or otherwise coupled to the first flexible restraint for pulling the stretcher 1 and moving a victim who may be restrained on the stretcher 1. In some embodiments, the pull line 24 may be connected to the first flexible restraint. Indeed, the pull line 24 may be used to pull the stretcher 1, and platform 10, from a confined space and also drawing the first flexible restraint 20 through the channel 43. By drawing the first flexible restraint 20 through the channel 43, the first flexible restraint 20 may be tightened against the victim restrained on the stretcher 1. The pull line 24 may be connected to the first flexible restraint 20 via junction 25. In certain embodiments, junction 25 may be a knot, a clamp, stitching, or a splice. In other embodiments, such as those disclosed in FIGS. 5 and 6, junction 25 may include a loop 250 (e.g., a loop of cord) to which the first the flexible restraint may be connected. In accordance with the foregoing, the pull line 24 may be an extension of the first flexible restraint 20 and, therefore, the pull line 24 and first flexible restraint 20 may be of the same material. For example the first flexible restraint 20 may exit the channel 43 at aperture 42 and a portion of the first flexible restraint 20 that extends beyond the platform 10 may be the pull line 24. In such instances, junction 25 may serve to join or connect two of the first flexible restraints 20 that may be exiting channels 43, as shown in FIG. 1, for example.

Regarding the flexible restraints (e.g., 20 and 30) of the invention more broadly, such restraints may have a fixed length or may have a variable length. When the restraints of the invention include a variable length, the length may be varied by including one or more buckles on a portion of the respective restraint. In particular instances, at least one of the first and second flexible restraints 20 and 30, respectively, may have a fixed length. In other instances, both the first and second flexible restraints 20 and 30, respectively, have fixed lengths.

In an alternative embodiment, channels 43 may optionally extend to apertures 50. Indeed, rather than connecting the second flexible restraint 30 to internal frame 51 at third strut 51*c*, the second flexible restraint 30 may be passed around third strut 51*c* and enclosed within channel 43. Restraint 30 may then pass through restraint lock 41 and be in communication with or otherwise coupled to pull line 24 in a manner as described for first flexible restraint 20. In some embodiments, the pull line 24 may be connected to the first flexible restraint 20. In this alternative embodiment, pulling on pull line 24 draws both first flexible restraint 20 and second flexible restraint 30 through channel 43 to tighten said restraints against a victim.

In some embodiments, the pull line 24 may be a strap, webbing, cord, or a combination thereof. Particularly, the pull line 24 may be webbing (e.g., polyamide, polypropylene, polyester, para-aramid, and/or Dyneema® webbing) or cord (e.g., polyamide paracord). In preferred aspects, the pull line 24 may be cord.

One end of the pull line 24 may be connected to a pull line container 27 that may be used to store the pull line 24. The pull line container 27 may also include a weight to allow the pull line container 27 to be more efficiently thrown by one rescuer to another in order to facilitate extraction of the stretcher 1 during use. In some embodiments, the pull line container 27 may be a throw bag. The pull line container 27 may also be releasably connected to the platform 10 through the use of two or more releasable fasteners 28. For example, the platform 10 may include a first releasable fastener 28*a* and the pull line container 27 may include a second releasable fastener 28*b* that may be connected to the first releasable fastener 28*a*. The releasable fasteners 28 of the invention may include hook-and-loop fasteners (e.g., Velcro®), snap buttons, or the like. Preferably, the first releasable fastener 28*a* and second releasable fastener 28*b* are hook-and-loop fasteners.

The platform 10 may include one or more retainers on a surface of the platform 10 for holding the first locking member 21 and/or second locking member 31 when the stretcher 1 is not in use. Preferably, the stretcher 1 may include two retainers that may be located on the victim facing surface of the platform 10.

For example, the platform 10 may include a first retainer 60 that may be located proximate to the top 10*a* of the platform 10. The first retainer 60 may include an aligning boss 61 that may orient the first locking member 21 in the first retainer 60. Moreover, the first retainer 60 may include one or more keepers 62 (e.g., about three keepers) to releasably lock the first locking member 21 in the first retainer 60. Additionally, the platform 10 may include a second retainer 70 that may be located proximate to the bottom 10*b* of the platform 10. The second retainer 70 may include an aligning boss 71 that may orient the second locking member 21 in the second retainer 70. Moreover, the second retainer 70 may include one or more keepers 72 (e.g., about three keepers) to releasably lock the second locking member 31 in the second retainer 70.

The platform 10 may also include one or more support structures 80 that may be used to support and/or immobilize portions of a victim's body, when the victim is restrained on the platform 10. For example, one or more support structures 80 may be releasably connected (e.g., with a releasable fastener) or fixed (e.g., with adhesive) to the victim facing surface of the platform 10 to support and/or immobilize a victim's head, left arm, right arm, pelvis, neck, ribs, or a combination thereof. In some embodiments, the platform 10 includes two support structures 80 to immobilize the victim's head and/or neck.

Figure 4:
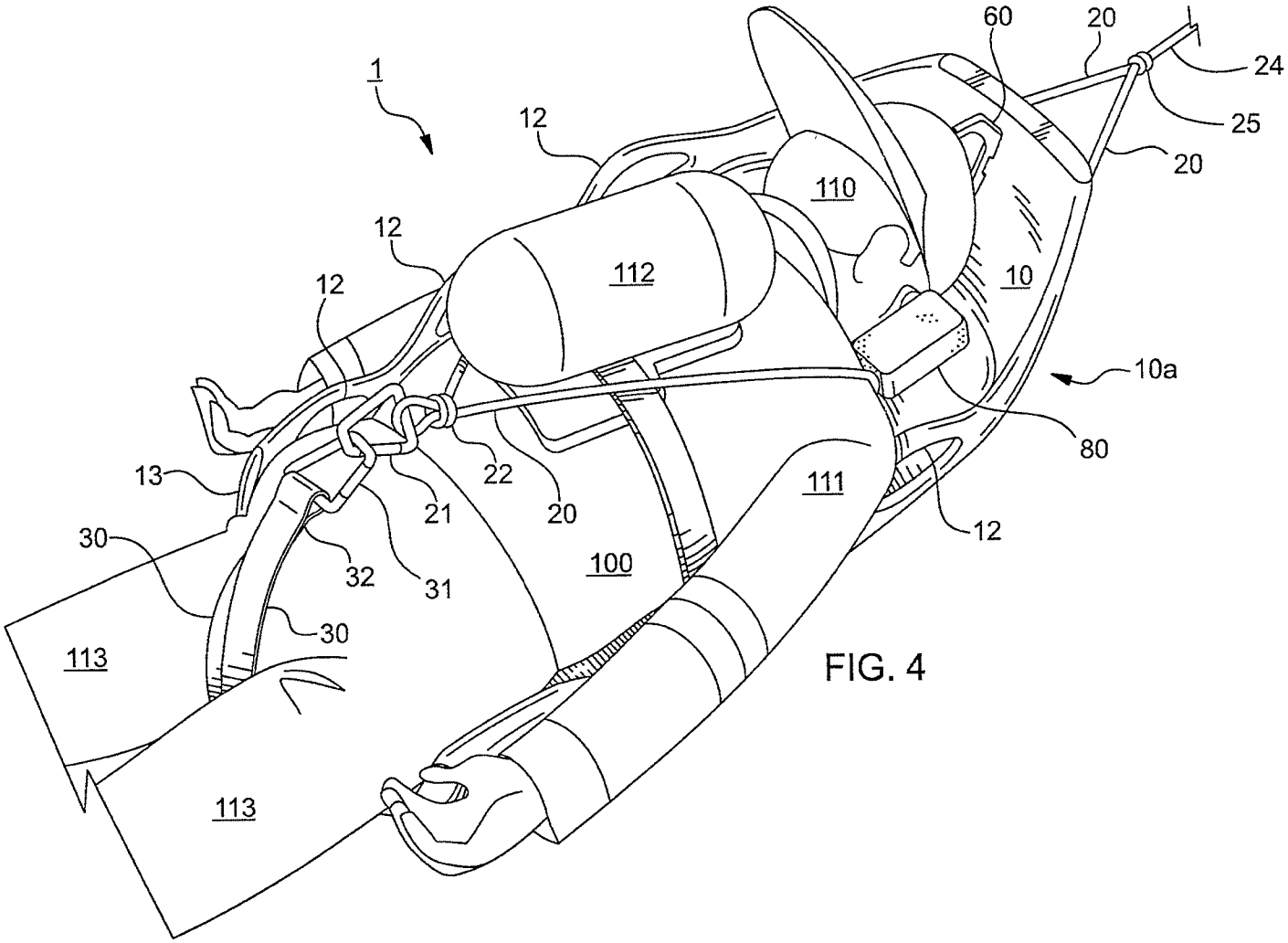
FIG. 4 illustrates a use of the first exemplary emergency rescuer stretcher of the invention for extricating an injured fireman in the face down position who is wearing a self-contained breathing apparatus (SCBA).

FIG. 4 demonstrates an exemplary use of an emergency rescue stretcher 1 for the extrication of a firefighter 100. An incapacitated firefighter 100 is disclosed in FIG. 4 as laying face down on the stretcher 1 with his head between support structures 80. In this configuration, the firefighter 100 is laid face down to accommodate the SCBA bottle 112 carried on his back and the SCBA mask.

Upon discovery of the injured or incapacitated firefighter 100, and after providing any necessary first aid, the stretcher 1 would be prepared for restraint of the injured firefighter 100. Specifically, the first and second locking members 21 and 31, respectively, are removed from the first and second retainers 60 and 70. Moreover, the pull line container 27 may be also disconnected from the platform 10. The injured firefighter 100 may then be laid face down on the platform 10 with his head 110 placed between support structures 80 (e.g., foam blocks). First flexible restraint 20, which may be a cord in stretcher 1, may then be drawn over the firefighter's head 110, arms 111, and SCBA bottle 112. First flexible restraint 20 may need to be slackened by releasing restraint locks 41. Second flexible restraint 30, which may be webbing in stretcher 1, may then be drawn between the firefighter's legs 113. The first and second locking member 21 and 31, which are both carabiners in stretcher 1, may then be connected. Upon connecting locking members 21 and 31, the pull line 24 may be pulled by rescue personnel to draw the first flexible restraint 20 through the channel 43 and thereby tighten the first flexible restraint 20 and second flexible restraint 30 against the injured firefighter 100 to secure him on the platform. The pull line 24 may be further pulled by rescue personnel to extricate the injured firefighter 100 from danger and/or a confined space.

The present invention further includes other embodiments, such as emergency rescue stretchers 2, 3, and 4. Stretcher 2 is depicted in FIG. 5, stretcher 3 is depicted in FIG. 6, and stretcher 4 is depicted in FIGS. 7-12.

Figure 5:
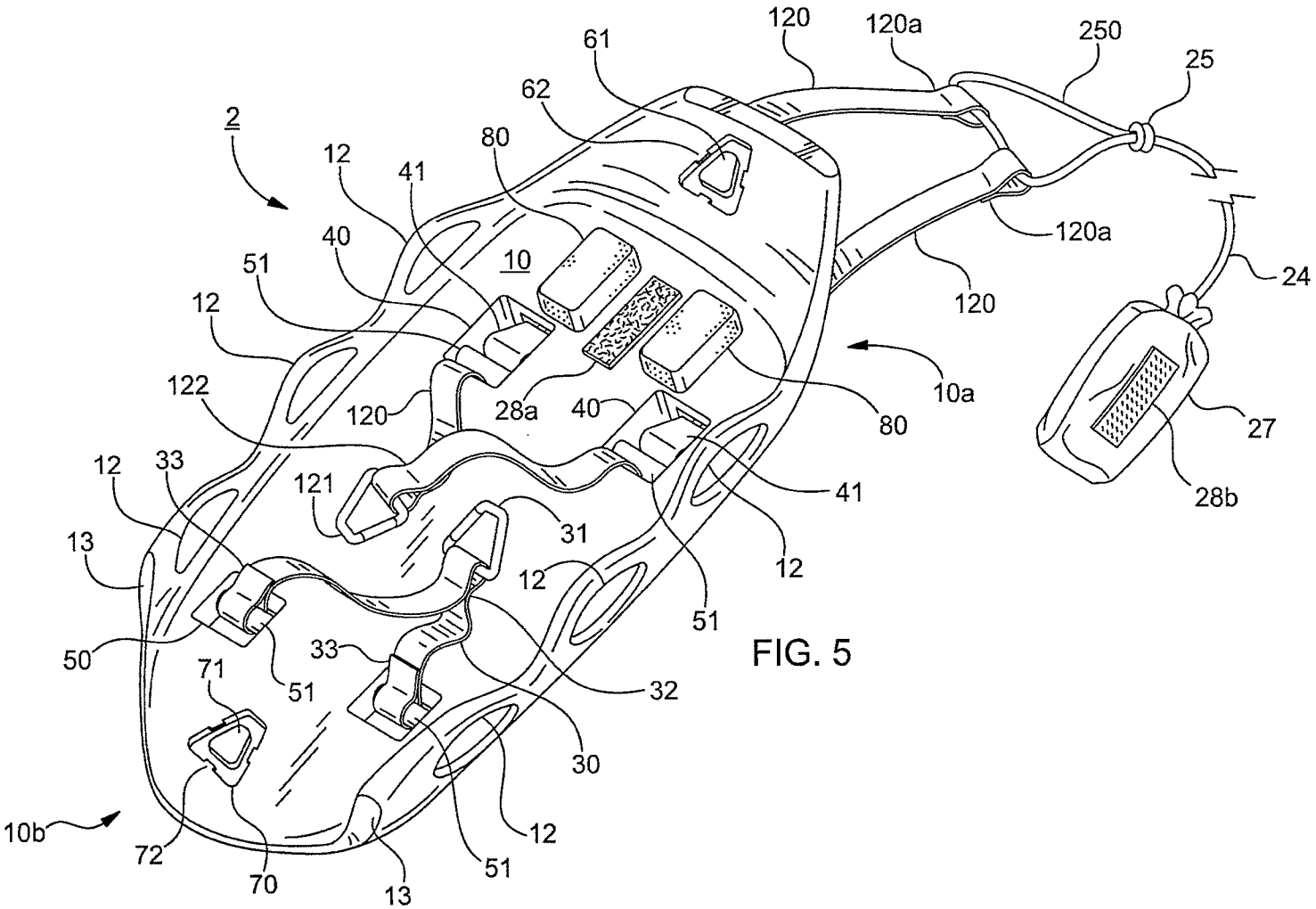
FIG. 5 illustrates a rear perspective view of a second exemplary emergency rescue stretcher of the invention.

FIG. 5 includes an emergency rescue stretcher 2, which utilizes a first flexible restraint 120 that may be composed of webbing. The first flexible restraint 120 may further include a first locking member 121, which may be a clip, a buckle, tri-link, or a carabiner. In particular, the first locking member 121 may be a carabiner. Additionally, the position of the first locking member 121 on the first flexible restraint 120 may be maintained by a first fixation element 122, which may be a knot in the first flexible restraint 120, a clamp, a splice, stitching, or a weld. Particularly, the first fixation element 122 may be stitching. For example, two or more portions of the first flexible restraint 120 may be stitched together in order to maintain the position of the first locking member 121 on the first flexible restraint 120.

Moreover, first flexible restraint 120 may pass through the platform 10 via apertures 40 as described above in relation to first flexible restraint 20 in emergency rescue stretcher 2 to connect with pull line 24 at junction 25, which may include a loop 250. In some embodiments, first flexible restraint 120 may connect with loop 250 through connecting loops 120*a*.

Figure 6:
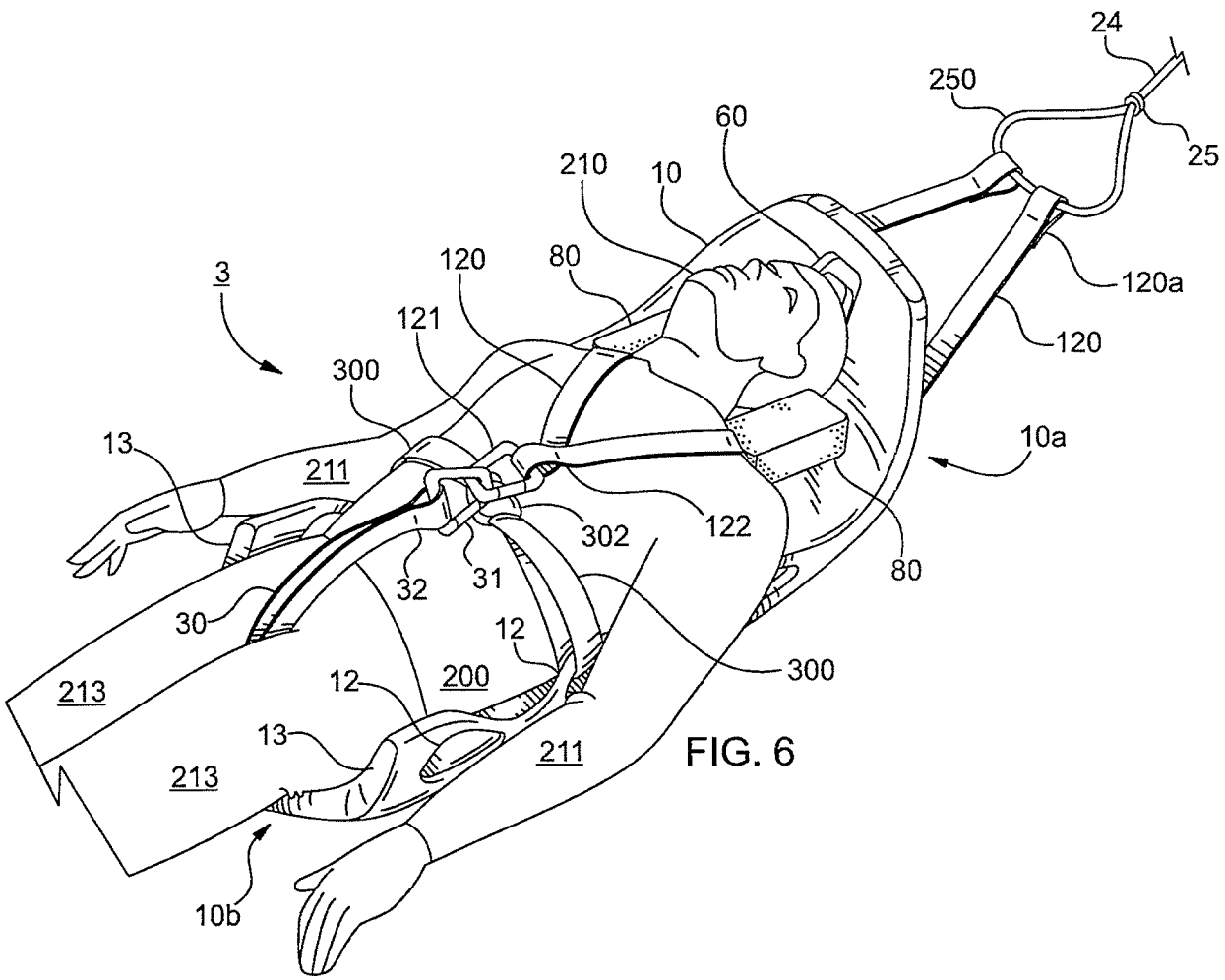
FIG. 6 illustrates a use of a third exemplary emergency rescue stretcher of the invention for extricating a victim in the face up position.

FIG. 6 demonstrates an exemplary use of an emergency rescue stretcher 3. Stretcher 3 may be substantially similar to stretcher 2, except that stretcher 3 includes a third flexible restraint 300 that may be connected to platform 10 and restrain a portion of a victim's body. For example, the third flexible restraint 300 may connect to the platform 10 at one of the handholds 12, as depicted in FIG. 6. Indeed, a portion of the third flexible restraint may be looped through one of the handholds 12 that may be provided on either side of the platform 10. In some embodiments, the third flexible restraint 300 may be a strap, webbing, cord, or a combination thereof. Particularly, the third flexible restraint 300 may be webbing (e.g., polyamide, polypropylene, polyester, para-aramid, and/or Dyneema® webbing) or cord (e.g., polyamide paracord). The third flexible restraint 300 may also include a third locking member 302, which may be a set of locking members. In particular, third locking member 302 may include one or more clips, buckles, tri-links, and/or carabiners that may allow the third flexible restraint to be tightened against a victim 200, as necessary, to assist in securing the victim 200 on the platform 10. The third locking member 302 may also allow the third flexible restraint 300 to be varied in length or shortened and, thereby, tightened against the victim.

An incapacitated victim 200 is shown in FIG. 6 as laying face up on the stretcher 3 with his head between support structures 80.

Upon discovery of the injured victim 200, and after providing any necessary first aid, the stretcher 3 may be prepared for restraint of the injured victim 200. Specifically, the first and second locking members 121 and 31, respectively, may be removed from the first and second retainers 60 and 70. Moreover, the pull line container 27 may also be disconnected from the platform 10. The injured victim 200 may then be laid face up on the platform 10 with his head 210 placed between support structures 80 (e.g., foam blocks). First flexible restraint 120, which may be webbing in stretcher 3, may then be drawn over the victim's head 210 and arms 211. First flexible restraint 120 may need to be slackened by releasing restraint locks 41. Second flexible restraint 30, which may be webbing in stretcher 3, may then be drawn between the victim's legs 113. The first and second locking member 21 and 31, which are both carabiners, or other locking devices as described herein or known to a person having ordinary skill in the art, in stretcher 3, may then be connected. Furthermore, third flexible restraint 300 may be connected to platform 10 at handholds 12 and placed across the victim's body. The third flexible restraint 300 may then be tightened and locked in place with the third locking member 302.

Upon connecting locking members 21 and 31, the pull line 24 may be pulled by rescue personnel to draw the first flexible restraint 120 through the channel 43 and thereby tighten the first flexible restraint 120 and second flexible restraint 30 against the injured victim 200 to secure him on the platform. The pull line 24 may be further pulled by rescue personnel to extricate the injured victim 200 from danger and/or a confined space.

In a still further embodiment, platform 10 may include an extension system for supporting the legs of a victim. For example, the bottom 10*b* of platform 10 may include two or more rods, having cross members, that may be extracted from the platform 10 to support a portion of the victim's legs.

An exemplary emergency rescue stretcher 4 of the invention is depicted in FIGS. 7-12. Stretcher 4 includes a platform 510, a first flexible restraint 520, and a second flexible restraint 530.

Figure 7:
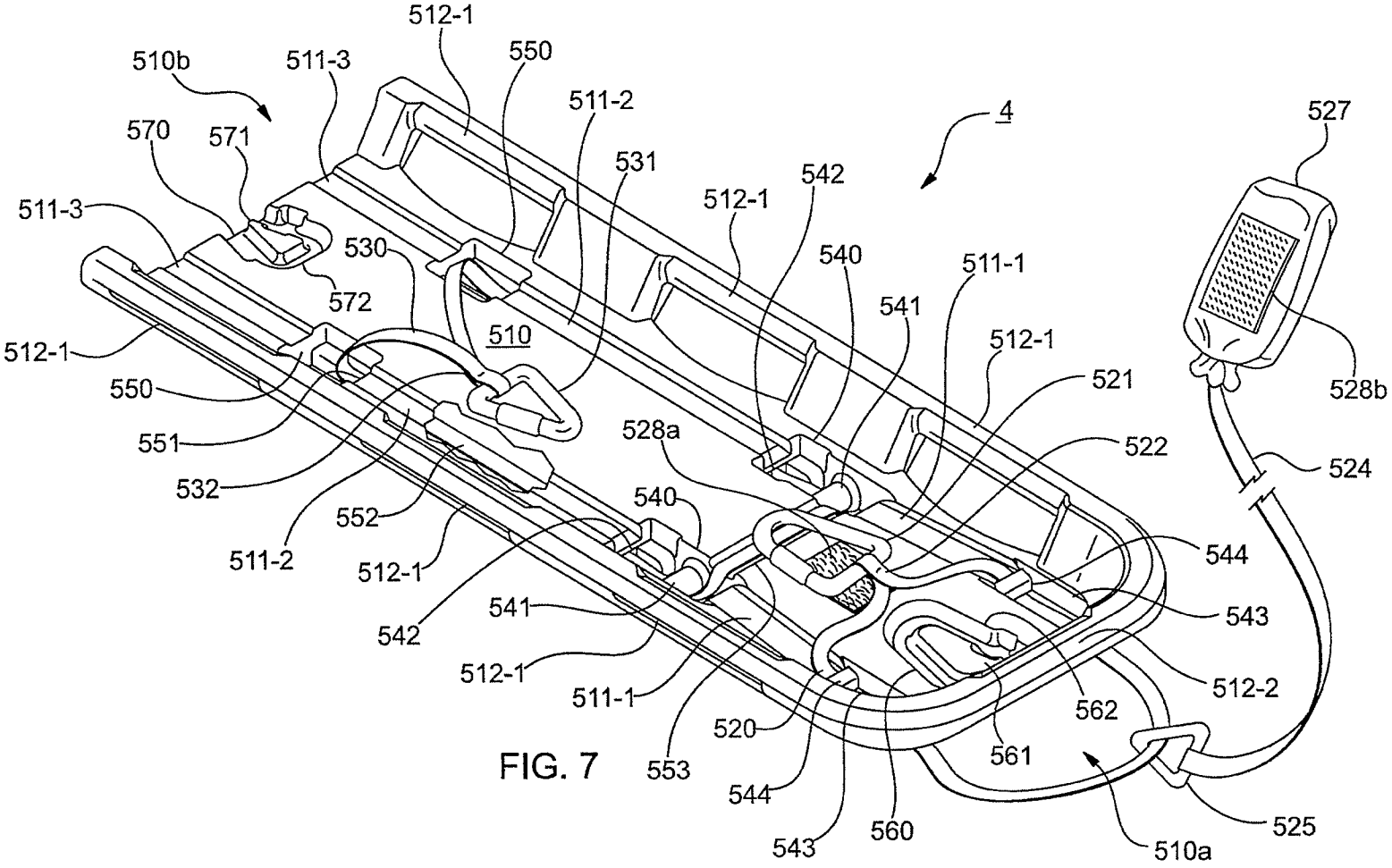
FIG. 7 illustrates a perspective view of a fourth exemplary emergency rescue stretcher of the invention.

The platform 510 includes a rigid body for supporting a victim restrained thereon. The platform 510 may be composed of a polymeric material, which may include a polyethylene polymer, polypropylene polymer, polyamide polymer (e.g., nylon), para-aramid polymer (e.g., Kevlar®), Dyneema®, or any combination or copolymer thereof. The platform 510 may be sized to secure the head, torso, and pelvis of a victim. As shown in FIG. 7, the platform 510 provides a board that may be concave to support a victim disposed thereon. Moreover, the platform 510 includes a top portion 510*a* and a bottom portion 510*b*. The top portion 510*a* of the platform 510 may be curved or otherwise angled to protect the victim's head and, further, enables the stretcher 4 to be more easily pulled over obstacles or stairs.

Figure 11:
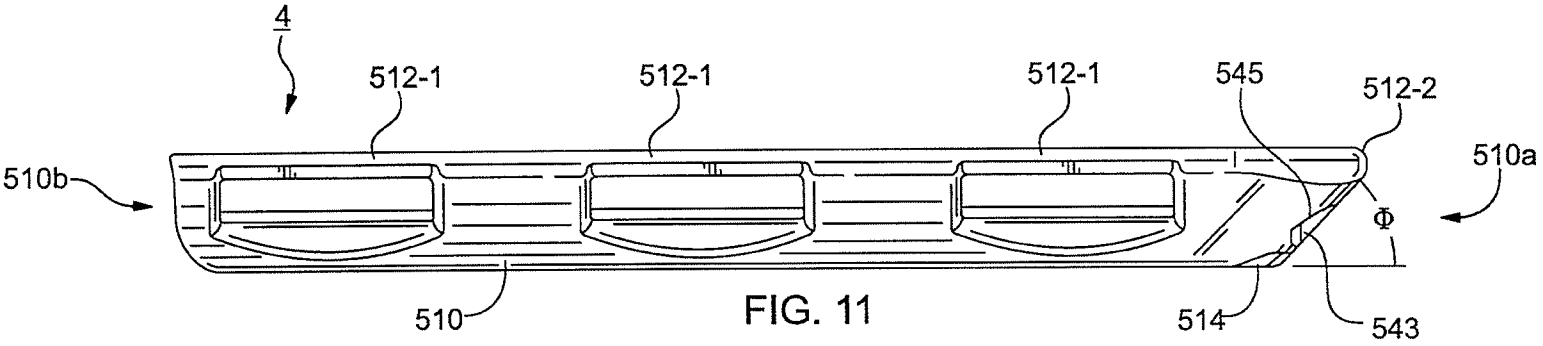
FIG. 11 illustrates a side view of the fourth exemplary emergency rescue stretcher of the invention without the first or second flexible restraints.

With reference to FIG. 11, the top portion 510*a* of the platform 510 may be curved away from a plane that passes through the lower surface of the platform 510. Indeed, as shown in FIG. 11, the top portion 510*a* of the platform 510 may be curved at an angle Φ with respect to the plane that passes through the lower surface of the platform 510, where Φ may be preferably about 45°. Angling the top portion 510*a* of the platform 510 may allow for the stretcher 4 to be more easily slid along the ground during extraction of a victim. Moreover, the use of a 45° angle may reduce defeat of the stretcher 4 by stairs or other obstacles during extraction.

The platform 510 may also include handholds 512 that are disposed on the sides of the platform 510 (i.e., 512-1) as well as at the top portion 510*a* of the platform 510 (i.e., 512-2). The stretcher 4 may be shown as having 7 handholds total.

Figure 10:
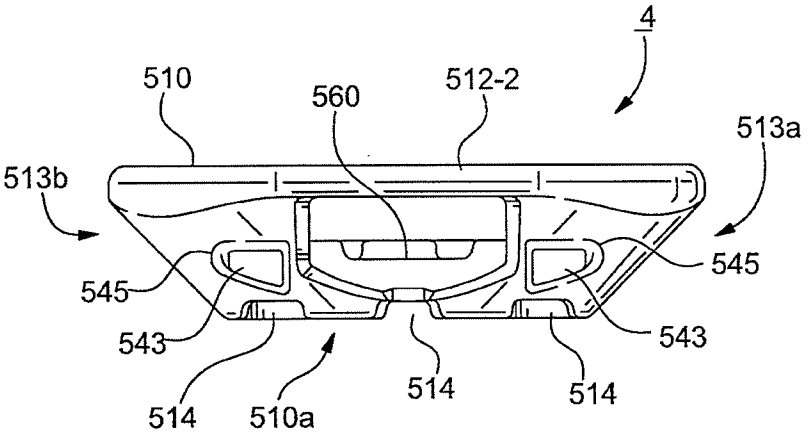
FIG. 10 illustrates a front view of the fourth exemplary emergency rescue stretcher of the invention without the first or second flexible restraints.
Figure 9:
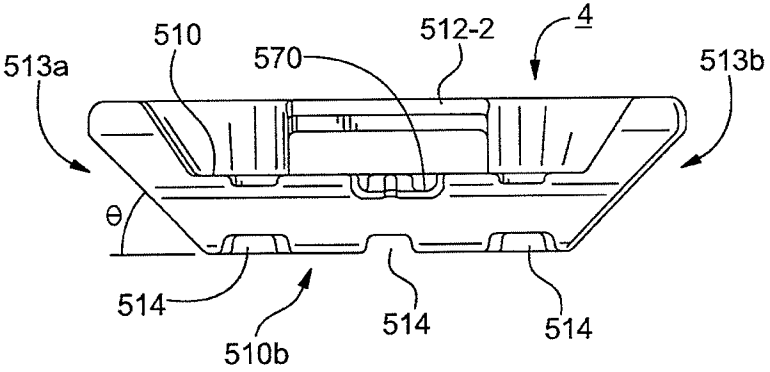
FIG. 9 illustrates a rear view of the fourth exemplary emergency rescue stretcher of the invention without the first or second flexible restraints.

Referring to the sides of the platform 510 more specifically, as shown in FIGS. 9 and 10, the left and right sides of the platform 510, 513*a* and 513*b*, respectively, may be curved at an angle θ with respect to the plane that passes through the lower surface of the platform 510, where θ may be preferably about 45°.

The platform 510 also includes apertures 540, 545, and 550. Apertures 540 include one or more apertures or cut outs on the victim facing surface of the platform 510 that are disposed proximate to the top 510*a* of the platform 510. Furthermore, apertures 550 include one or more apertures or cut outs on the victim facing surface of the platform 510 that are disposed proximate to the bottom 510*b* of the platform 510. Apertures 540 include support struts 541 that traverse the width of the apertures 540.

The platform 510 may include channels 543 that extended from the victim facing side of the platform 510 at restraint locks 544 to apertures 545, which are disposed on the underside of the platform 510 proximate to the top portion 510*a* of the platform 510 as shown in FIGS. 7 and 10.

The platform 510 may include a first flexible restraint 520 that may be used to restrain a first portion of a victim on the platform 510. In one embodiment, the first portion of the victim includes the victim's torso. The first flexible restraint 520 includes a flexible piece of material that passes through apertures 545, channels 543, and restraint locks 544.

With respect to FIG. 7, restraint locks 544 are, as described hereinabove, locks may allow the first flexible restraint 520 to pass in one direction, but lock by friction and prevent the flexible restraint 520 from passing in the other direction. The restraint locks 544 are fixed to the platform 510. Restraint locks 544 are configured to apply a restraining force against the first flexible restraint 520 by use of a spring disposed at the restraint locks 544 as would be understood by a person having ordinary skill in the art. Specifically, the restraint locks 544 include cams that allow the first flexible restraint 520 to pass through the channels 543 and thus allow the first flexible restraint 520 to be tightened against a victim's torso. However, after tightening, the restraint locks 544 prevent the loosening of the first flexible restraint 520, until the restraint locks 544 are released by disengaging the restraint locks 544 from the first flexible restraint 520.

The first flexible restraint 520 may be a strap, webbing, cord, or a combination thereof. Particularly, the first flexible restraint 520 may be webbing (e.g., polyamide, polypropylene, polyester, para-aramid, and/or Dyneema® webbing) or cord (e.g., polyamide paracord). The first flexible restraint 520 is shown in FIG. 7 as webbing.

The first flexible restraint 520 also includes a first locking member 521, which may be a clip, a buckle, tri-link, or carabiner. The first locking member 521 in FIG. 7 may be a carabiner. Furthermore, the position of the first locking member 521 on the first flexible restraint 520 may be maintained by a first fixation element 522, which may be a knot in the first flexible restraint 520, a clamp, a splice, stitching (e.g., wherein at least two portions of the flexible restraint are sewn together), or weld. Particularly, the first fixation element 522 may be a knot in the first flexible restraint 520.

The platform 510 also includes a second flexible restraint 530 that may be configured to restrain a second portion of the victim disposed in the platform 510. Specifically, the second portion of the victim includes the victim's pelvis. The second flexible restraint 530 includes a flexible piece of material that passes through both apertures 540 and 550. As shown in FIG. 7, the second flexible restraint 530 may be removably connected to the platform 510 at mounting point or groove 553. Indeed, the second flexible restraint 530 may be connected to the platform 510 by a loop of restraint material at the mounting point 553, which may be formed in the victim facing surface of the platform 510. The second flexible restraint 530 passes around struts 541 and through apertures 542 which are disposed within apertures 540. The struts 541 may include a rod that may be disposed within the platform 510 or may be monolithic with the platform 510 as shown in stretcher 4 (i.e., formed from the platform 510). The platform 510 includes channels 552 that connect apertures 540 and 550. The second flexible restraint 530 passes through apertures 542, channels 552, apertures 551, and exit the platform 510 at apertures 550 (apertures 551 are disposed within apertures 550). During operation, a load may be distributed about the struts 541 and mounting point 553 when the load is placed on the second flexible restraint 530.

The second flexible restraint 530 may be a strap, webbing, cord, or combination thereof. Particularly, the second flexible restraint 530 may be webbing (e.g., polyamide, polypropylene, polyester, para-aramid, and/or Dyneema® webbing) or cord (e.g., polyamide paracord). For example, the stretcher 4 includes a second flexible restraint 530 that may be webbing.

The second flexible restraint 530 also includes a second locking member 531, which may be a clip, a buckle, a tri-link, or a carabiner. In particular, the second locking member 531 may be a carabiner. Furthermore, the position of the second locking member 531 on the second flexible restraint 530 may be maintained by second fixation element 532, which may be a knot in the second flexible restraint 530, a clamp, a splice, stitching, or weld. Particularly, the second fixation element 532 may be a knot in the second flexible restraint 530.

As described herein, the first locking member 521 may be connectable with the second locking member 531 to maintain or secure a victim on the platform 510. For example, when connecting the first locking member 521 to the second locking member 531, tightening of the first flexible restraint 520 against the victim results in the tightening of the second flexible restraint 530. The first locking member 521 and the second locking member 531 are releasably connectable.

The stretcher 4 may also include a pull line 524 that may be in communication with or otherwise coupled to the first flexible restraint for pulling the stretcher 4 and moving a victim who is restrained on stretcher 4. In some embodiments, the pull line 524 may be connected to the first flexible restraint. Indeed, the pull line 524 may be used to pull the stretcher 4, and platform 510, from a confined space while also drawing the first flexible restraint 520 through the channel 543. By drawing the first flexible restraint 520 through the channel 543, the first flexible restraint 520 may be tightened against the victim restrained on the stretcher 4. The pull line 524 may be connected to the first flexible restraint 520 via junction 525. The junction 525 may be a knot, a clamp, stitching, or a splice. The junction 525 may also include a carabiner that may be connected to a loop of first flexible restraint 520 as shown in FIG. 7.

In some embodiments, the pull line 524 may be a strap, webbing, cord, or combination thereof. Particularly, the pull line 524 includes webbing (e.g., polyamide, polypropylene, polyester, para-aramid, and/or Dyneema® webbing) or cord (e.g., polyamide paracord). In one embodiment, the pull line 524 in FIG. 7 may be a cord.

One end of the pull line 524 may be connected to a pull line container 527 that may be configured to store the pull line 524. The pull line container 527 may also include a weight to allow the pull line container 527 to be more efficiently thrown by one rescuer to another in order to facilitate extraction of the stretcher 4 during use. Pull line container 527 also functions as a throw bag. The pull line container 527 may also be releasably connected to the platform 510 through the use of two releasable fasteners 528 (i.e., fasteners **528*a* and 528*b*). The platform 510 may include a first releasable fastener 528*a* and the pull line container 527 includes the second releasable fastener 528*b*. The releasable fasteners 528** are hook-and-loop fasteners (e.g., Velcro®).

Figure 8:
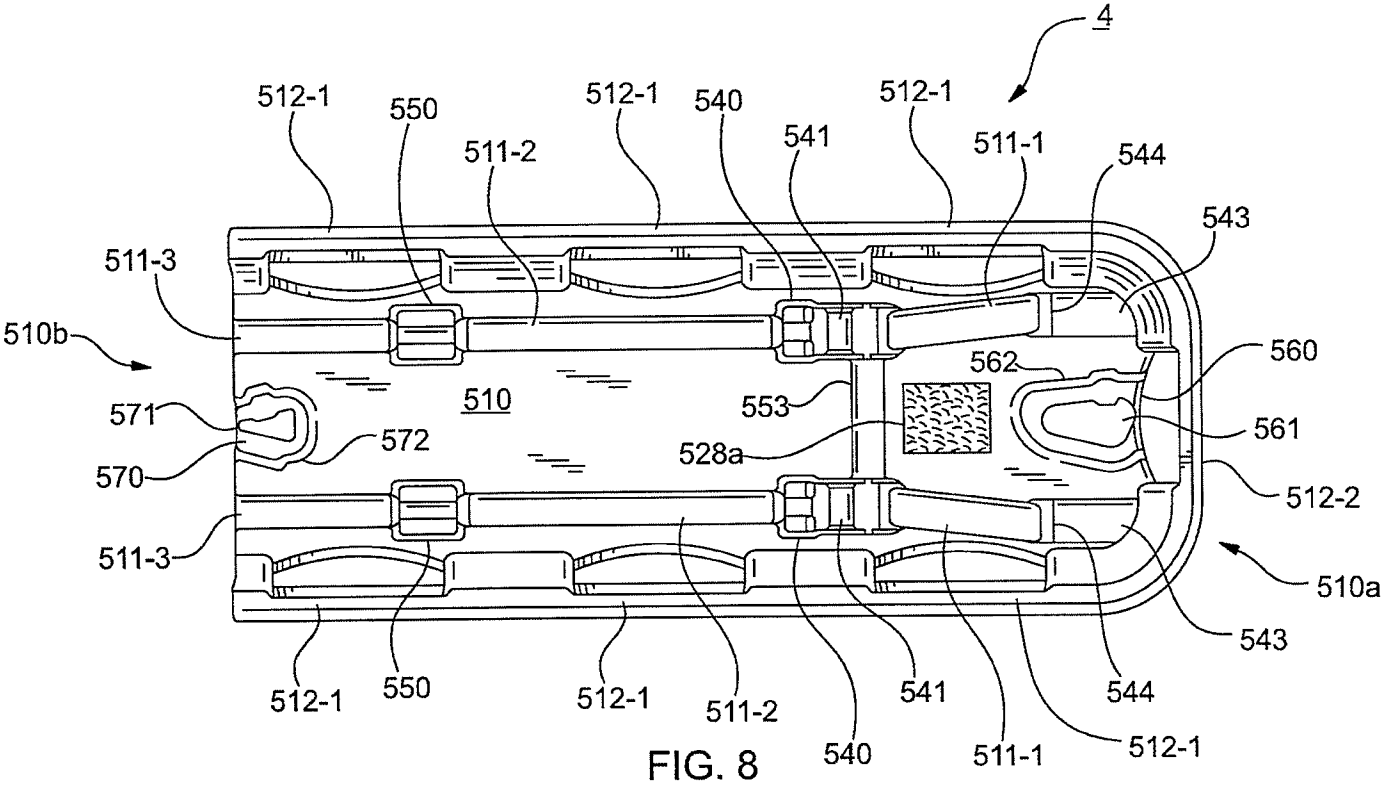
FIG. 8 illustrates a top view of the exemplary emergency rescue stretcher of FIG. 7 without the first or second flexible restraints.

The platform 510 may also include two retainers for holding the first locking member 521 and the second locking member 531 when the stretcher 4 is not in use. As shown in FIGS. 7 and 8, the two retainers are located on the victim facing surface of the platform 510.

The platform 510 may include a first retainer 560 that may be located proximate to the top **510*a* of the platform 510. The first retainer 560 includes an aligning boss 561 that orients the first locking member 521 in the first retainer 560. Moreover, the first retainer 560 may include a keeper 562 that releasably locks the first locking member 521 in the first retainer 560. Additionally, the platform 510 may include a second retainer 570 that may be located proximate to the bottom 510*b* of the platform 510. The second retainer 570 may include an aligning boss 571 that orients the second locking member 521 in the second retainer 570. The second retainer 570 also includes a keeper 572 that releasably locks the second locking member 531 in the second retainer 570**.

With respect to FIGS. 7 and 8, the platform 510 may include grooves 511 that provide support and rigidity to the platform 510. Specifically, the platform 510 includes support grooves 511-1 between the restraint locks 544 and the apertures 540; support grooves 511-2 between the apertures 540 and 550; and support grooves 511-3 between apertures 550 in the bottom **510*b* of the platform 510**.

Figure 12:
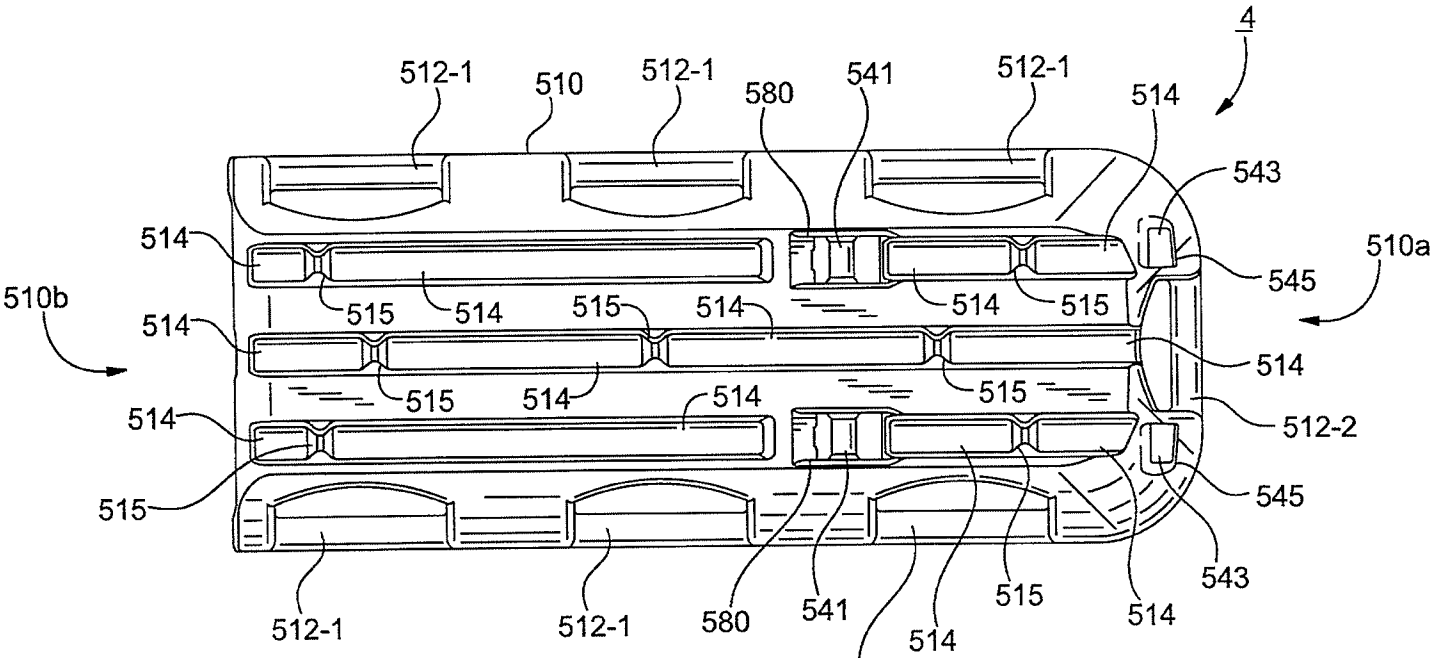
FIG. 12 illustrates a bottom view of the fourth exemplary emergency rescue stretcher of the invention without the first or second flexible restraints.

With respect to FIGS. 9, 10, and 12, the lower surface of the platform 510 includes various support grooves 514. The support grooves 514 may include kiss points 515. The kiss points 515 connect a lower, internal surface of the platform 510 to an upper, internal surface of the platform 510. Specifically, the kiss points 515 provide additional support and rigidity to the platform 510.

As shown in FIG. 12, the lower surface of the platform 510 may include apertures 580, which are pass-throughs to apertures 540 on the victim facing surface of the platform 510.

Regarding the emergency rescue stretchers of the invention more broadly, in some embodiments, the platforms of such stretchers may include a rigid body that may be hollow and may include a filler material.

In various embodiments of the invention, the rigid body may include a filler material. The filler material may be a buoyant filler material that may provide neutral buoyancy to a stretcher of the invention when bearing a victim in water. For example, the buoyant filler material may include a foam polymer material (e.g., polyvinyl chloride foam and/or polyethylene foam). Additionally, the stretcher of the invention may include one or more additional buoyancy aids and flotation devices that may be affixed to the platform.

Any platform, rigid body, and/or filler material of the invention may include a ballistic material, as defined herein. The ballistic material may include a soft ballistic material and/or a hard ballistic material. For example, soft ballistic materials of the invention may include, without limitation, one or more of a para-aramid fiber-based ballistic material (e.g., Kevlar® and Twaron®) and a polyethylene fiber-based ballistic material (e.g., Spectra Shield®). The hard ballistic materials of the invention may include, without limitation, one or more of a ceramic-based material (e.g., a ceramic matrix composite (CMC) material) and a polycarbonate-based material (e.g., Lexan®).

In certain embodiments, the ballistic materials of the invention may be affixed to and/or coated on an interior or exterior surface of the rigid body. Accordingly, certain stretchers of the invention that include ballistic materials may be used as shields during extraction operations when rescuing victims.

In certain additional embodiments of the invention, the stretcher may include one or more flaps that may be affixed to the platform and may be folded over a victim disposed on the stretcher. The flaps (e.g., two flaps) may be secured about the victim by one or more releasable fasteners. The one or more flaps may include a ballistic material (e.g., a soft ballistic material), as described herein.

A number of patent and non-patent publications may be cited herein in order to describe the state of the art to which this invention pertains. The entire disclosure of each cited publication is incorporated by reference herein.

While certain embodiments of the present invention have been described and/or exemplified above, various other embodiments will be apparent to those skilled in the art from the foregoing disclosure. The present invention is, therefore, not limited to the particular embodiments described and/or exemplified, but is capable of considerable variation and modification without departure from the scope and spirit of the appended claims.

Moreover, as used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Furthermore, the transitional terms "comprising", "consisting essentially of" and "consisting of", when used in the appended claims, in original and amended form, define the claim scope with respect to what unrecited additional claim elements or steps, if any, are excluded from the scope of the claim(s). The term "comprising" is intended to be inclusive or open-ended and does not exclude any additional, unrecited element, method, step or material. The term "consisting of" excludes any element, step or material other than those specified in the claim and, in the latter instance, impurities ordinary associated with the specified material(s). The term "consisting essentially of" limits the scope of a claim to the specified elements, steps or material(s) and those that do not materially affect the basic and novel characteristic(s) of the claimed invention. All devices and methods described herein that embody the present invention can, in alternate embodiments, be more specifically defined by any of the transitional terms "comprising," "consisting essentially of," and "consisting of."

I claim:

1. An emergency rescue stretcher, comprising:

a. a platform configured to support a person, the platform comprising a channel extending from an aperture on a surface of the platform and a restraint lock;

b. a first flexible restraint configured to restrain a first portion of the person and having a first locking member, a portion of the first flexible restraint being enclosed within the channel and releasably connected to the restraint lock, wherein drawing the first flexible restraint through the channel tightens the first flexible restraint against the person;

c. a second flexible restraint configured to restrain a second portion of the person and having a second locking member, a portion of the second flexible restraint connected to the platform, wherein the first and second locking members are releasably connectable to maintain the person on the platform; and d. a pull line coupled to the first flexible restraint and configured to pull the platform and draw the first flexible restraint through the channel.

2. The emergency rescue stretcher of claim 1, wherein the platform comprises a plurality of handholds for lifting the stretcher.

3. The emergency rescue stretcher of claim 1, wherein the platform comprises a push point configured to receive a pushing force parallel to the stretcher.

4. The emergency rescue stretcher of claim 1, wherein the platform comprises a curved portion toward an end of the platform that curves upwardly from a top surface of the platform.

5. The emergency rescue stretcher of claim 1, wherein the restraint lock comprises two restraint locks.

6. The emergency rescue stretcher of claim 1, wherein the restraint lock comprises a cam.

7. The emergency rescue stretcher of claim 1, wherein the channel comprises two channels.

8. The emergency rescue stretcher of claim 1, wherein the channel comprises two channels and the restraint lock comprises two restraint locks.

9. The emergency rescue stretcher of claim 1, wherein the first flexible restraint comprises a strap, webbing, a cord, or a combination thereof.

10. The emergency rescue stretcher of claim 1, wherein the first flexible restraint comprises webbing.

11. The emergency rescue stretcher of claim 10, wherein the pull line comprises a loop configured to connect an end of the pull line to the first flexible restraint.

12. The emergency rescue stretcher of claim 1, wherein the platform comprises an internal frame.

13. The emergency rescue stretcher of claim 1, wherein the pull line comprises a junction configured to fix a proximal end of the pull line to the first flexible restraint.

14. The emergency rescue stretcher of claim 13, wherein the junction comprises a knot, stitching, a clamp, a carabiner, or a splice.

15. The emergency rescue stretcher of claim 1, wherein the pull line comprises a pull line container configured to contain a portion of the pull line.

16. The emergency rescue stretcher of claim 15, wherein the platform comprises a releasable fastener and the pull line container comprises an additional releasable fastener, which is configured to releasably fasten the pull line container to the releasable fastener at the platform.

17. The emergency rescue stretcher of claim 1, wherein the first locking member comprises a clip, a buckle, tri-link, or a carabiner.

18. The emergency rescue stretcher of claim 1, wherein the platform comprises an internal frame and the internal frame comprises a strut and the portion of the second flexible restraint is connected to the strut.

19. The emergency rescue stretcher of claim 1, wherein the second flexible restraint comprises a strap, webbing, cord, or a combination thereof.

20. The emergency rescue stretcher of claim 1, wherein the second flexible restraint comprises webbing.

21. The emergency rescue stretcher of claim 1, wherein the platform comprises a locking member retainer configured to hold one of the first and second locking members.

22. The emergency rescue stretcher of claim 1, wherein the platform comprises a support structure configured to immobilize the person's head, left arm, right arm, pelvis, neck, ribs, or a combination thereof.

23. The emergency rescue stretcher of claim 1, comprising a third flexible restraint connected to the platform and configured to restrain a portion of the person.

24. The emergency rescue stretcher of claim 23, wherein the third flexible restraint comprises a strap, a belt, webbing, a cord, or a combination thereof.

25. The emergency rescue stretcher of claim 23, wherein the third flexible restraint comprises a third locking member selected from the group consisting of a clip, a buckle, tri-link, and a carabiner.

26. The emergency rescue stretcher of claim 1, wherein the platform comprises a rigid body.

27. The emergency rescue stretcher of claim 26, wherein the rigid body is supported by one or more of a plurality of kiss points and a plurality of grooves.

28. The emergency rescue stretcher of claim 1, wherein the platform comprises a mounting point and the second flexible restraint is connected to the platform by a loop of the second flexible restraint at the mounting point.

29. The emergency rescue stretcher of claim 1, wherein the platform comprises carbon fiber, polyethylene polymer, polypropylene polymer, polyamide polymer, para-aramid polymer, Dyneema®, or a combination thereof.

30. The emergency rescue stretcher of claim 1, wherein the platform comprises a ballistic material.

31. The emergency rescue stretcher of claim 1, wherein the platform comprises a filler material.

32. The emergency rescue stretcher of claim 31, wherein the filler material comprises one or more of a buoyant filler material and a ballistic filler material.

33. The emergency rescue stretcher of claim 32, wherein the filler material comprises a ballistic filler material comprising a soft ballistic filler material, a hard ballistic filler material, or a combination thereof.

34. The emergency rescue stretcher of claim 1, comprising one or more flaps that are connected to the platform and are configured to cover a person on the stretcher, wherein the flaps comprise a ballistic material.

35. The emergency rescue stretcher of claim 1, wherein a side of the platform is curved at about a 45° angle relative to a surface of the platform.

36. The emergency rescue stretcher of claim 1, wherein a front portion of the platform is curved at about a 45° angle relative to a surface of the platform.

37. A method of removing a person from a confined space using an emergency rescue stretcher, the method comprising the steps of:

a. providing an emergency rescue stretcher according to claim 1;

b. placing the person on the stretcher;

c. drawing the first flexible restraint over the person's head;

d. drawing the second flexible restraint between the person's legs;

e. connecting the first locking member and the second locking member; and f. pulling the pull line to tighten the first flexible restraint against the person and move the stretcher from the confined space.

* * * * *